US008955617B2

(12) United States Patent
Roehm

(10) Patent No.: US 8,955,617 B2
(45) Date of Patent: Feb. 17, 2015

(54) HAND-HELD POWER TOOL COMPRISING A SPINDLE FOR RECEIVING A TOOL

(75) Inventor: Heiko Roehm, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 929 days.

(21) Appl. No.: 13/119,929

(22) PCT Filed: Aug. 12, 2009

(86) PCT No.: PCT/EP2009/060429

§ 371 (c)(1),
(2), (4) Date: May 20, 2011

(87) PCT Pub. No.: WO2010/034565

PCT Pub. Date: Apr. 1, 2010

(65) Prior Publication Data

US 2011/0220380 A1 Sep. 15, 2011

(30) Foreign Application Priority Data

Sep. 29, 2008 (DE) ..... 10 2008 042 423

(51) Int. Cl.
*B25F 5/00* (2006.01)

(52) U.S. Cl.
CPC .. *B25F 5/001* (2013.01); *B25F 5/00* (2013.01)
USPC ..... 173/217; 173/216; 173/176; 173/178

(58) Field of Classification Search
CPC ..... B25F 5/00; B25F 5/001
USPC ..... 173/216, 217, 176, 178, 179; 475/331
See application file for complete search history.

(56) References Cited

U.S. PATENT DOCUMENTS

| | | | | |
|---|---|---|---|---|
| 4,823,627 | A | 4/1989 | Mills | |
| 4,923,047 | A | 5/1990 | Fink et al. | |
| 5,947,254 | A | 9/1999 | Jones | |
| 7,131,503 | B2 * | 11/2006 | Furuta et al. | 173/216 |
| 2007/0205077 | A1 * | 9/2007 | Nakamura | 192/116.5 |

FOREIGN PATENT DOCUMENTS

| | | |
|---|---|---|
| CN | 2307659 | 2/1999 |
| CN | 1385939 | 12/2002 |
| CN | 1519080 | 8/2004 |
| CN | 101090806 | 12/2007 |
| CN | 101204741 | 6/2008 |
| DE | 37 42 952 | 7/1989 |
| DE | 103 50 619 | 6/2005 |
| DE | 10 2004 058 809 | 6/2006 |
| DE | 10 2006 059 633 | 6/2009 |
| EP | 1 083 029 | 3/2001 |
| EP | 2 095 909 | 9/2009 |
| WO | WO 2009/024165 | 2/2009 |

* cited by examiner

*Primary Examiner* — Michelle Lopez
(74) *Attorney, Agent, or Firm* — Kenyon & Kenyon LLP

(57) ABSTRACT

A hand-held power tool includes a gearbox that is coupled to a spindle for receiving a tool, the spindle being mounted via a tool-side bearing and a motor-side bearing, and the motor-side bearing being braced radially against a component of the gearbox.

29 Claims, 1 Drawing Sheet

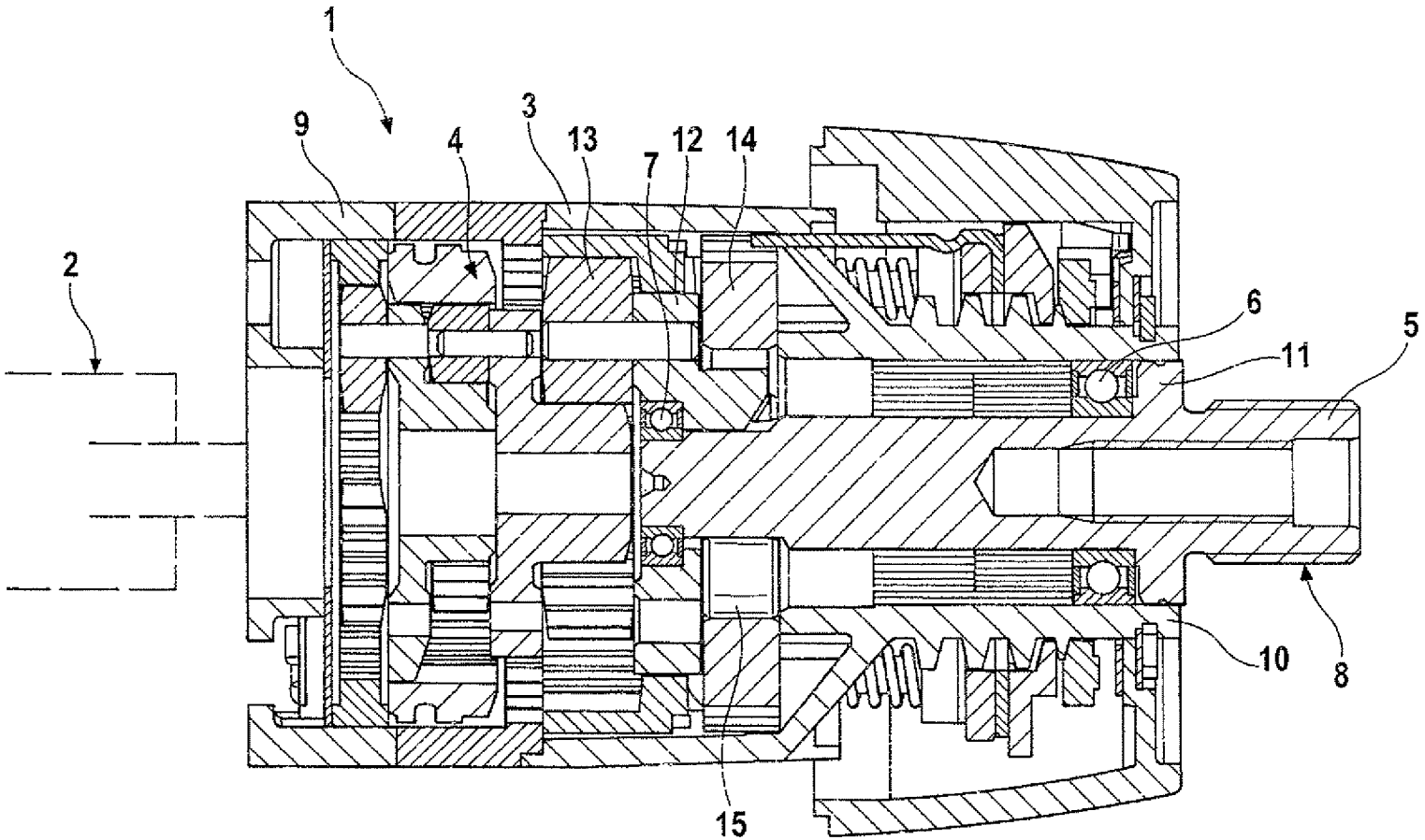
1
2
3
4
5
6
7
8
9
10
11
12
13
14
15

HAND-HELD POWER TOOL COMPRISING A SPINDLE FOR RECEIVING A TOOL

FIELD OF THE INVENTION

The present invention relates to a hand-held power tool, in particular an electrically operated hand-held power tool such as, for example, a cordless screwdriver or cordless drill, having a spindle for receiving a tool.

BACKGROUND INFORMATION

German Patent No. 10 2004 058 809 describes a hand-held power tool, configured as a cordless screwdriver, whose electrical drive motor drives, via a multi-stage planetary gearbox, a spindle for receiving a tool. The spindle is rotatably mounted via a tool-side bearing and, spaced axially away therefrom, via a motor-side bearing, the tool-side bearing usually being embodied as a fixed bearing and the motor-side bearing as a floating bearing. The motor-side floating bearing is located axially between the end region of the spindle at which the latter is coupled to a component of the planetary gearbox, and the tool-side fixed bearing.

In order to achieve a low radial runout for the tool, it is advantageous if the bearing points for mounting the spindle are spaced as far apart from one another as possible. On the other hand, however, in order to achieve short overall lengths for the drive train it is desirable to keep the bearing spacing as short as possible or to select only one bearing; this comes, however, at the expense of runout quality and mechanical rigidity.

SUMMARY OF THE INVENTION

An object of the present invention is to provide, with simple design actions, a hand-held power tool such as, for example, a cordless screwdriver with a short overall length, the intention being at the same time to achieve high runout quality for the spindle that receives the tool.

The hand-held power tool according to the present invention, which is in particular an electrically operated hand-held power tool such as, for example, a cordless screwdriver, a cordless drill/screwdriver, a cordless impact driver, or a cordless drill, is equipped with a gearbox that is disposed in the drive train between the drive motor of the hand-held power tool and a spindle for receiving a tool. By way of the gearbox, a stepdown of the high drive speed of the motor to the desired lower rotation speed of the spindle takes place. The spindle is mounted via a tool-side bearing and a motor-side bearing, the motor-side bearing being braced radially against a component of the gearbox.

This embodiment has a variety of advantages. In particular, the overall length can be reduced because a component of the gearbox participates directly in bracing of the motor-side bearing, so that the motor-bearing is inserted axially as far as the region of the gearbox, or the gearbox extends axially as far as the bearing. The gearbox component against which the bearing is radially braced can, if applicable, be used to drive the spindle. An embodiment that is particularly compact in an axial direction is thereby achieved. At the same time, a comparatively long bearing spacing can be implemented, in particular in the advantageous embodiment such that the motor-side bearing is located adjacently to that end face of the spindle which faces toward the gearbox. The comparatively large bearing space results in excellent runout quality. In addition, the power dissipation of the bearing is reduced by the fact that the motor-side bearing braces the spindle not against the stationary gearbox housing, but against the rotating planet carrier.

The aforesaid advantages can be achieved in cost-neutral fashion. No additional components are necessary in order to implement the bearing system according to the present invention for the spindle in the hand-held power tool.

According to a useful embodiment, the gearbox is embodied as a planetary gearbox, which preferably has two or more stages for stepping down the drive speed of the electrical drive motor to the spindle rotation speed. The motor-side bearing is braced radially against a gearbox part of the planetary gearbox, in particular against a planet carrier; axial bracing against the gearbox component is dispensed with, so that in this case the motor-side bearing, usefully, is axially connected fixedly to the spindle. If applicable, an axial bracing in at least one axial direction is additionally permitted. If applicable, an axial bracing in both axial directions of the spindle by way of the relevant gearbox component is also a possibility.

In the case of multi-stage planetary gearboxes, the motor-side bearing can be radially braced, for example, by a planet carrier close to the motor or by the middle planet carrier. It is moreover also possible for the motor-side bearing to be radially braced in the pinion of the tool-side planetary stage or the pinion of the middle planetary stage.

The motor-side bearing is preferably embodied as a floating bearing having axial movement capability, whereas the tool-side bearing is usefully embodied as a fixed bearing with axial immobilization with respect to the housing of the hand-held power tool. As already mentioned above, the motor-side floating bearing can be secured axially on the planet carrier and mounted in axially movable fashion on the spindle. Another possibility is an embodiment in which the floating bearing is axially secured on the spindle and held axially movably in the planet carrier.

Also possible are embodiments in which both bearings are embodied as floating bearings or both bearings as fixed bearings, or the tool-side bearing is embodied as a floating bearing and the motor-side bearing as a fixed bearing. The bearings can be embodied either as rolling bearings or as plain bearings; also possible, if applicable, is a mixed embodiment in which one bearing is embodied as a rolling bearing and one bearing as a plain bearing.

In a further advantageous embodiment, a spindle lock, which is disposed axially between the tool-side bearing and the motor-side bearing, is provided in order to center the spindle. The spindle lock encompasses spindle lock rollers to center the spindle, which usefully are disposed axially between the fixed and floating bearings of the spindle.

BRIEF DESCRIPTION OF THE DRAWING

The FIGURE shows a hand-held power tool in section in the region of a planetary gearbox and a spindle.

DETAILED DESCRIPTION

Hand-held power tool 1 has an electric drive motor 2, depicted only schematically, whose motor shaft is coupled to a planetary gearbox 4 that is disposed in a gearbox housing 3 of the hand-held power tool. Planetary gearbox 4 transfers the rotational motion of drive motor 2, with a stepdown ratio, to a spindle 5 mounted coaxially in the gearbox housing, the exposed end face of the spindle being equipped with an external thread 8 for attaching a drill chuck into which a tool can be clamped. Spindle 5 is mounted rotatably in gearbox housing 3 via a tool-side bearing 6 adjacent to the exposed end face as well as a motor-side bearing 7 facing toward planetary gearbox 4. Gearbox housing 3 is partly encased by a motor housing (not depicted) that receives drive motor 2.

Gearbox housing 3 has an internally located hollow-cylindrical bearing mandrel 10 for receiving spindle 5. Spindle 5 possesses a radially enlarged, annularly peripheral support collar 11 that adjoins the radial inner side of bearing mandrel adjacent to the end face of the bearing mandrel. Disposed on support collar 11, on the axially inner side facing toward the drive motor, is tool-side bearing 6, which is braced in an axial direction (toward the exposed end face of spindle 5) against support collar 11. Tool-side bearing 6 is braced radially outwardly against the inner shell of bearing mandrel 10.

Planetary gearbox 4 has at least one planet carrier 12 that is the carrier of planet gears 13. Planet carrier 12 encloses spindle 5 in the region of its end face facing toward the drive motor. The motor-side bearing 7, which is located immediately adjacent to the end face of spindle 5, is likewise radially surrounded by planet carrier 12; bearing 7 is braced radially outwardly against planet carrier 12.

A spindle lock 14, which is disposed axially between the two bearings 6 and 7 and encompasses spindle rollers 15 that abut directly against the spindle and secure it in the desired centered position, is provided in order to center spindle 5 when drive motor 2 is switched off. Spindle lock 14 partly wraps around planet carrier 12.

Bearings 6 and 7 can respectively be embodied as floating bearings or as fixed bearings; in a preferred embodiment, the tool-side bearing 6 is embodied as a fixed bearing and the motor-side bearing 7 as a floating bearing, thus allowing an axial relative displacement capability between spindle 5 and planet carrier 12. Bearings 6 and 7 are preferably embodied as rolling bearings; if applicable, an embodiment as plain bearings is also a possibility.

What is claimed is:

1. A hand-held power tool, comprising:

a tool-side bearing and a motor-side bearing;

a spindle for driving a tool; and a planetary gearbox coupled to the spindle, the spindle being mounted via the tool-side bearing and the motor-side bearing, wherein the motor-side bearing is braced radially outward against a component of the planetary gearbox, the component being a rotating planet carrier of the planetary gearbox, wherein the planet carrier is a carrier of planet gears.

2. The hand-held power tool according to claim 1, wherein the motor-side bearing is braced axially against the component of the gearbox.

3. The hand-held power tool according to claim 1, wherein the planetary gearbox has at least two stages.

4. The hand-held power tool according to claim 1, wherein the motor-side bearing is a floating bearing having axial movement capability.

5. The hand-held power tool according to claim 1, wherein the tool-side bearing is a fixed bearing with axial immobilization with respect to a housing of the hand-held power tool.

6. The hand-held power tool according to claim 1, further comprising: a spindle lock for centering the spindle, the spindle lock including spindle lock rollers situated axially between the tool-side bearing and the motor-side bearing.

7. The hand-held power tool according to claim 1, wherein the motor-side bearing is situated adjacent to an end face of the spindle.

8. The hand-held power tool according to claim 1, wherein at least one of the bearings is a rolling bearing.

9. The hand-held power tool according to claim 1, wherein the hand-held power tool is an electrically operated hand-held power tool.

10. The hand-held power tool according to claim 9, wherein the hand-held power tool is a cordless screwdriver.

11. The hand-held power tool according to claim 9, wherein the hand-held power tool is a cordless drill.

12. The hand-held power tool according to claim 1, wherein the planet carrier radially surrounds the motor-side bearing.

13. The hand-held power tool as defined in claim 1, wherein the planet carrier radially surrounds the spindle in a region of an end face of the spindle facing toward a drive motor.

14. The hand-held power tool as defined in claim 1, further comprising a spindle lock which includes at least one component that partly surrounds the planet carrier in a radial direction. *

15. The hand-held power tool as defined in claim 1, wherein the motor-side bearing is axially connected fixedly to the spindle.

16. The hand-held power tool as defined in claim 15, wherein the motor-side bearing is axially braced in at least one axial direction against the component of the planetary gearbox.

17. The hand-held power tool according to claim 1, wherein at least one of the bearings is a plain bearing.

18. A hand-held power tool, comprising:

a tool-side bearing and a motor-side bearing;

a spindle for driving a tool; and a planetary gearbox coupled to the spindle, the spindle being mounted via the tool-side bearing and the motor-side bearing, wherein the motor-side bearing is braced radially outward against a component of the gearbox, the component being a component of the planetary gearbox rotating in the same direction.

19. The hand-held power tool according to claim 18, wherein the motor-side bearing is braced axially against the component of the gearbox.

20. The hand-held power tool according to claim 18, wherein the motor-side bearing is a floating bearing having axial movement capability.

21. The hand-held power tool according to claim 18, wherein the tool-side bearing is a fixed bearing with axial immobilization with respect to a housing of the hand-held power tool.

22. The hand-held power tool according to claim 18, further comprising:

a spindle lock for centering the spindle, the spindle lock including spindle lock rollers situated axially between the tool-side bearing and the motor-side bearing. axially between the tool-side bearing and the motor-side bearing.

23. The hand-held power tool according to claim 18, wherein the component of the planetary gearbox rotating in the same direction radially surrounds the motor-side bearing.

24. The hand-held power tool according to claim 18, wherein the component of the planetary gearbox rotating in the same direction radially surrounds the spindle in a region of an end face of the spindle facing toward a drive motor.

25. The hand-held power tool according to claim 18, wherein the component of the planetary gearbox rotating in the same direction is embodied as a planet carrier which is a carrier of planet gears.

26. A hand-held power tool, comprising:

a tool-side bearing and a motor-side bearing;

a spindle for driving a tool; and a planetary gearbox coupled to the spindle, the spindle being mounted via the tool-side bearing and the motor-side bearing, wherein the motor-side bearing is configured to brace the spindle radially outward against a component of the gearbox, the component being a component of the planetary gearbox rotating in the same direction.

27. The hand-held power tool according to claim 26, further comprising:

a spindle lock for centering the spindle, the spindle lock including spindle lock rollers situated axially between the tool-side bearing and the motor-side bearing.

28. The hand-held power tool according to claim 26, wherein the motor-side bearing is situated adjacent to an end face of the spindle.

29. A hand-held power tool, comprising:

a tool-side bearing and a motor-side bearing;

a spindle for driving a tool;

a spindle lock including spindle lock rollers situated axially between the tool-side bearing and the motor-side being; and a planetary gearbox coupled to the spindle, the spindle being mounted via the tool-side bearing and the motor-side bearing, wherein the motor-side bearing is configured to brace the spindle radially outward against a component of the gearbox.

* * * * *